US006108894A

United States Patent [19]

Mizuki et al.

[11] Patent Number: 6,108,894

[45] Date of Patent: Aug. 29, 2000

[54] METHOD OF MAKING STRIKER FOR AUTOMOTIVE DOOR LATCH APPARATUS

[75] Inventors: Tetsuro Mizuki, Yamanashi-ken; Hitoshi Tsuji; Koji Chikata, both of Tochigi-ken, all of Japan

[73] Assignee: Mitsui Kinzoku Kogyo Kabushiki Kaisha, Tokyo, Japan

[21] Appl. No.: 08/640,443

[22] Filed: Apr. 30, 1996

Related U.S. Application Data

[62] Division of application No. 08/502,139, Jul. 13, 1995, abandoned.

[30] Foreign Application Priority Data

Jul. 14, 1994 [JP] Japan ..... 6-184155

[51] Int. Cl.[7] ..... B21D 39/00; E05B 15/02

[52] U.S. Cl. ..... 29/509; 29/522.1; 29/524.1; 292/340; 148/653

[58] Field of Search ..... 29/509, 505, 522.1, 29/524.1; 292/340; 148/648, 653

[56] References Cited

U.S. PATENT DOCUMENTS

| | | | |
|---|---|---|---|
| 1,511,822 | 10/1924 | Belcher | 29/505 X |
| 2,795,947 | 6/1957 | Peras . | |
| 4,000,390 | 12/1976 | Graff . | |
| 4,143,529 | 3/1979 | Brummett et al. . | |
| 4,602,813 | 7/1986 | Gergoe et al. | 292/340 |
| 4,650,231 | 3/1987 | Shimura et al. | 292/340 |
| 4,756,565 | 7/1988 | Myslicki et al. | 292/340 |
| 4,941,696 | 7/1990 | Yamada et al. | 292/340 |
| 4,974,274 | 12/1990 | Compton et al. | 29/505 |
| 4,981,313 | 1/1991 | Makamura | 292/340 |
| 4,998,179 | 3/1991 | Peterson et al. . | |
| 5,050,917 | 9/1991 | Hamada et al. | 292/340 |
| 5,209,531 | 5/1993 | Thau | 292/340 |
| 5,209,532 | 5/1993 | Nakamura et al. | 292/216 |
| 5,215,342 | 6/1993 | Yuge et al. | 292/340 |
| 5,263,238 | 11/1993 | Cooper | 29/444 |
| 5,405,461 | 4/1995 | Hermanson et al. . | |
| 5,429,688 | 7/1995 | Barbosa et al. . | |
| 5,689,882 | 11/1997 | Adachi et al. . | |

*Primary Examiner*—David P. Bryant
*Attorney, Agent, or Firm*—Browdy and Neimark

[57] ABSTRACT

A striker for use in a door latch apparatus comprises a base made of a normal-strength steel plate having a strength of 30 to 40 kg/mm$^2$ and a U-shaped member made of a high-strength steel rod having a strength equal to or higher than 70 kg/mm$^2$. The U-shaped member has inner and outer flanges, between which the base is firmly sandwiched. The inner flanges are formed without being heated. The U-shaped member is fixed to the base after hardened and tempered. After the U-shaped member is connected with the base, the base is not hardened or is not tempered.

16 Claims, 3 Drawing Sheets

FIG. 1
(PRIOR ART)
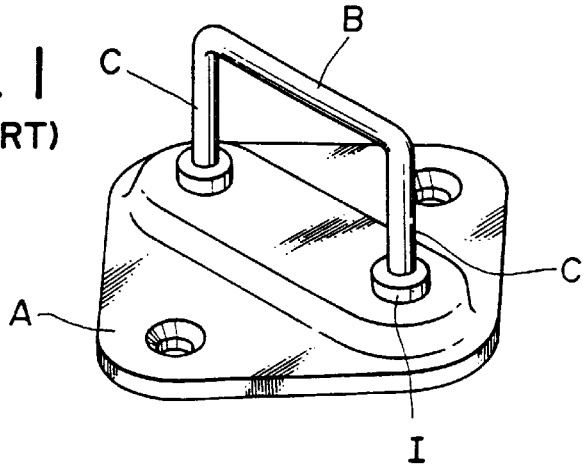
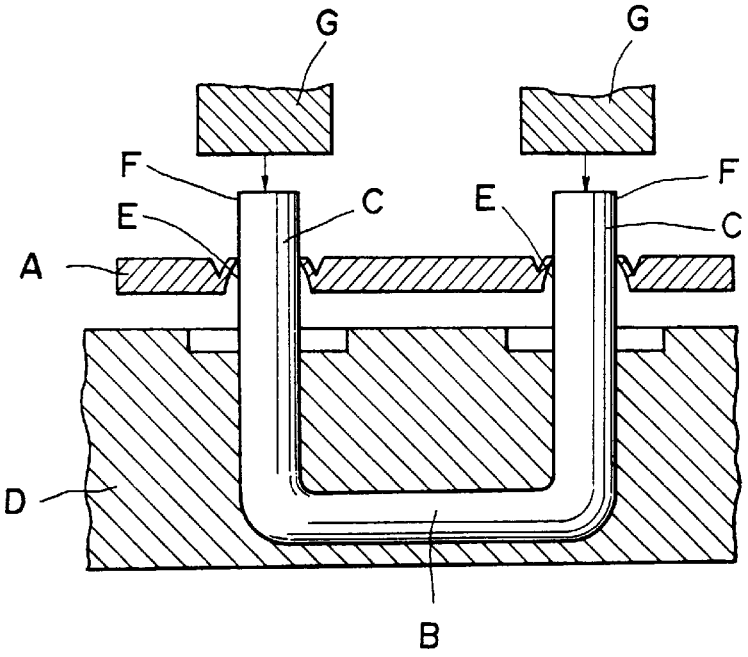
FIG. 2
(PRIOR ART)
FIG. 3
(PRIOR ART)
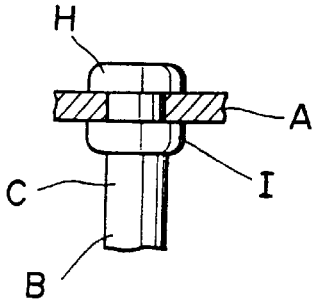

METHOD OF MAKING STRIKER FOR AUTOMOTIVE DOOR LATCH APPARATUS

This is a division of parent application Ser. No. 08/502,139 filed Jul. 13, 1995, now abandoned.

BACKGROUND OF THE INVENTION

1. Field of the Invention

This invention relates to a striker for an automotive door latch apparatus.

2. Description of the Prior Art

A conventional striker for use in a door latch apparatus, as illustrated in FIG. 1, has a metallic base A securely bolted to a vehicle body and a roughly U-shaped metallic member B attached to the base A. When making the striker, a linear rod made of a high-strength steel having a strength equal to or higher than 70 kg/mm$^2$ is cut to a part or fraction of an appropriate length, which is then bent roughly like a letter "U". Subsequently, the U-shaped member B is fitted into a jig D in such a manner that leg portions C and C thereof protrude from the jig D as illustrated in FIG. 2. Then, the leg portions C and C are inserted through a pair of holes E and E bored in the base A made of a normal-strength steel plate having a strength of 30 to 40 kg/mm$^2$. Next, tip parts F and F of the leg portions C and C are pressed by members G and G, respectively, by simultaneously heating both of the leg portions C and C, with the result that an inner flange H and an outer flange I, between which the base A is firmly sandwiched as shown in FIG. 3, are formed in each of the leg portions C and C. Thereafter, the entire striker is heat-treated (namely, hardened and tempered). Thus the striker is finished.

There are four primary reasons for heat-treating the striker. First, is to increase the strength and toughness of the rod B. To attain this object, the hardening and the tempering are necessary. Second, is to arrange the structure of the rod B, which has become rough or coarse by heating the leg portions C, C while forming the flanges H, I. To achieve this object, the tempering is needed. Third, is to restore the toughness of the rod, which has been lowered by heating the leg portions C, C when forming the flanges. To attain this object, the tempering becomes necessary. Fourth, is to eliminate internal stress produced when bending the rod to shape the rod like a letter "U". To achieve this object, the hardening and the tempering become necessary.

Conventional heat treatment is performed after the base A and the U-shaped member B are put together, so as to attain the four objects in one cycle of the hardening and tempering. Thus, although the base A does not need to be heat-treated, the base A is heat-treated together with the member B. Consequently, the heat-treating cost increases largely. Moreover, when heat-treating both of the base A and the U-shaped member B simultaneously, the connection or binding between the base A and the U-shaped member B sometimes becomes loose owing to the difference in thermal expansion coefficient therebetween.

Further, to prevent the connection or binding between the base A and the U-shaped member B from becoming loose, there has been previously proposed a method in which the process of the heat treatment is divided into a plurality of steps or stages. In the case of this method, the hardening and the tempering are performed on the rod B alone after the rod is bent like a letter "U". Subsequently, the rod is connected with the base A. Thereafter, the tempering of the base is performed. This conventional method, however, has problems that the tempering of the base A is also necessary and that the number of steps composing the process of the heat treatment is increased.

Moreover, a striker, especially, a striker for use in a bonnet is sometimes painted together with a vehicle body after the striker is attached to the vehicle body. It is desired that the base A of such a striker is plated with zinc which excels as a rust-proof undercoat. A low-cost method for obtaining a zinc-plated base is to first purchase a galvanized steel and next perform a press working on the galvanized steel to form a base. Heat applied to the base A at the time of hardening or forming the flanges, however, melts and evaporates zinc. Therefore, the zinc-plating coating which is considerably expensive is performed on the striker after the heat treatment.

SUMMARY OF THE INVENTION

Accordingly, an object of the present invention is to overcome the aforementioned problems of the prior art.

Further, another object of the present invention is to provide an improved striker by which the heat-treating cost is reduced.

Moreover, still another object of the present invention is to provide an improved striker in which no looseness occurs in the connection between a base and a U-shaped member.

Furthermore, yet another object of the present invention is to provide an improved striker in which a low-cost galvanized steel plate can be used as a base.

BRIEF DESCRIPTION OF THE DRAWINGS

Other features, objects and advantages of the present invention will become apparent from the following description of a preferred embodiment with reference to the drawings in which like reference characters designate like or corresponding parts throughout several views, and in which:

FIG. 1 is an external view of a conventional striker;

FIG. 2 is a sectional view of the conventional striker for illustrating a method of making thereof;

FIG. 3 is an expanded view of the connecting portion between a U-shaped member and a base of the conventional striker;

DETAILED DESCRIPTION OF THE PREFERRED EMBODIMENT

Hereinafter, the preferred embodiment of the present invention will be described in detail by referring to the accompanying drawings.

Figure 4:
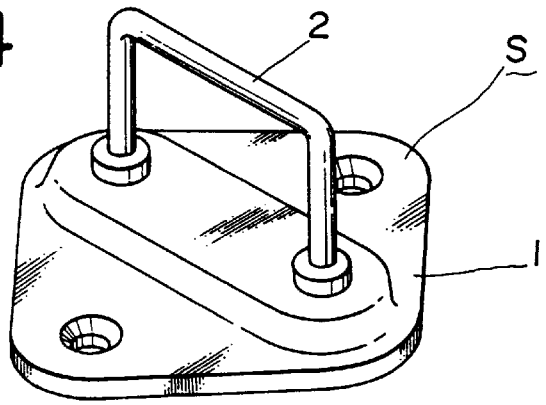
FIG. 4 is an external view of a striker of the present invention.
Figure 5:
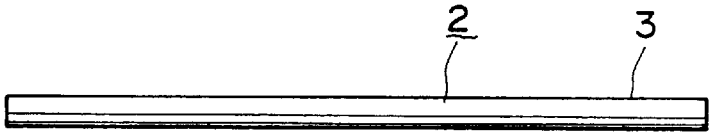
FIG. 5 is a plan view of a rod to be used as a material of the U-shaped member of the present invention.
Figure 6:
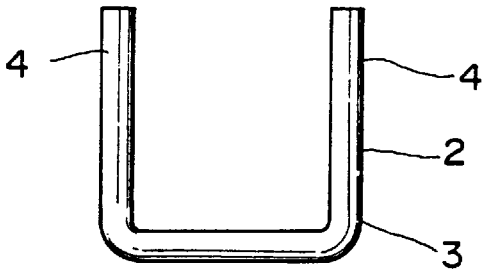
FIG. 6 is a plan view of a U-shaped rod obtained by bending the rod of FIG. 5 like a letter "U"

FIG. 4 illustrates a striker S of the present invention. The external appearance of the striker S is similar to that of the conventional striker of FIG. 1. The striker S has an almost diamond-shaped base 1 fixed to a vehicle body (not shown) with bolts (not shown) and further has a roughly U-shaped member 2 secured to the base 1. A linear steel rod 3 to be used as a material of the member 2 is first cut to the predetermined length as illustrated in FIG. 5. Preferably, the rod 3 is made of a high-strength steel product having a strength equal to or higher than 70 kg/mm$^2$, such as chrome molybdenum steel, chrome steel, nickel chromium steel, or nickel-chrome-molybdenum steel. Usually, the rod 3 has a circular or elliptic section. The rod 3 is bent almost like a letter "U" as illustrated in FIG. 6, by performing a press working or the like. Then, outer flanges 5 and 5 are formed on leg portions 4 and 4 of the rod 3 by performing a forging or the like (see FIG. 7). The outer flanges 5 and 5 are placed at positions on the leg portions 4 and 4, which are appropriately away from tips 6 and 6 of the leg portions 4 and 4. Incidentally, the outer flanges 5 and 5 may be formed on the rod 3 before the rod 3 is processed like a letter "U" as shown in FIG. 8.

Figure 7:
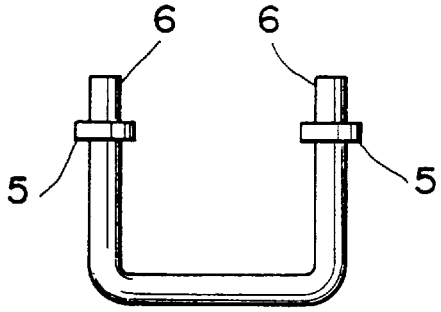
FIG. 7 is a plan view of the U-shaped rod of FIG. 6, on which outer flanges are formed.
Figure 8:
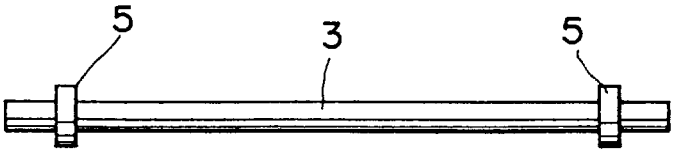
FIG. 8 is a plan view of the rod of FIG. 5, on which outer flanges are formed.

Subsequently, the rod 3 processed in the state of FIG. 7 is heat-treated (namely, hardened and tempered). The main objects of this heat treatment are to eliminate the internal stress, which occurs when bending the rod 3 like a letter "U", and to increase the strength and the toughness of the rod 3. If a scale or the like occurs in the surface portion of the rod 3 as the result of the heat treatment, the scale or the like is eliminated by using barrel polishing abrasives or the like.

Figure 9:
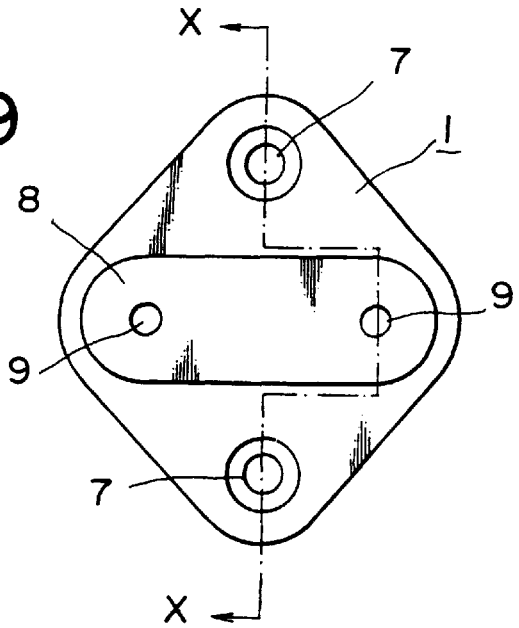
FIG. 9 is a plan view of a base of the present invention.
Figure 10:
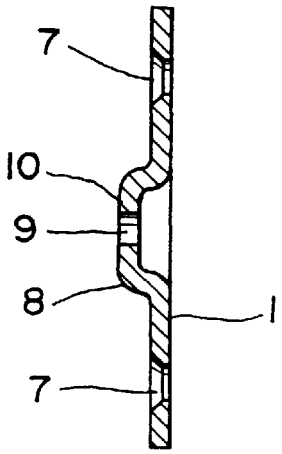
FIG. 10 is a sectional view of the base taken on line X—X of FIG. 9.

FIGS. 9 and 10 illustrate the base 1. Preferably, the base 1 is formed by stamping a normal-strength steel plate, such as a hot-rolled steel plate having a strength of 30 to 40 kg/mm$^2$, by performing a press working. Further, holes 7 and 7, into which bolts (not shown) for fixing the base 1 to the vehicle body are inserted, are bored in the top portion and the bottom portion of the base 1. A swelling portion 8 is formed at a middle position between the top and bottom portions of the base 1. In the swelling portion 8, fitting openings 9 and 9, into which the leg portions 4 and 4 of the U-shaped member 2 are respectively inserted, are bored in the swelling portion 8.

Figure 11:
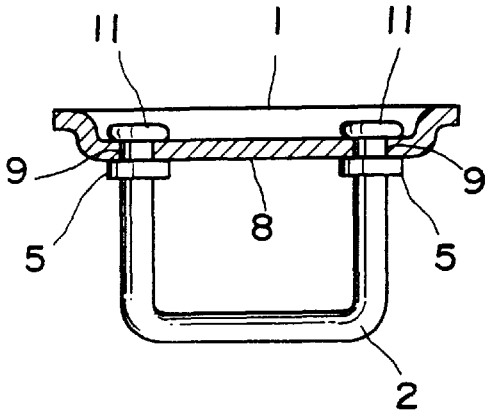
FIG. 11 is a sectional view of the striker of the present invention, in which the base is connected with the U-shaped member.

The heat-treated leg portions 4 and 4 of the U-shaped member 2 are inserted into the fitting openings 9 and 9 of the base 1, respectively. Further, the outer flanges 5 and 5 are brought into abutting engagement with an outer side face 10 of the swelling portion 8. Then, the protruding parts of the leg portions 4 and 4 are caulked by performing a cold-press-working or the like, without heating thereof. Thus, inner flanges 11 and 11 are formed on the inside surface of the swelling portion 8 as illustrated in FIG. 11. Thereby, the base 1 is firmly sandwiched between the inner flanges 11 and the outer flanges 5. Consequently, the U-shaped member 2 is securely fixed to the base 1.

In the case of the striker S made in this way, the inner flanges 11 are formed without being heated. Thus unnecessary heat treatment of the base can be omitted. Consequently, the heat-treating cost can be reduced considerably.

Further, because the heat treatment of the base can be omitted, the connection between the base 1 and the U-shaped member 2 can be prevented from becoming loose.

Moreover, because of the fact that the base is not heat-treated, a zinc-plated steel plate, the cost of which is considerably less than that in the case of employing the zinc-plating coating, can be used as the material of the base.

Furthermore, owing to the fact that the base is not heat-treated, the appearance of the base can be improved by preliminarily coating the base with resin.

Incidentally, in the case of the conventional striker, if the tip parts F and F of the leg portions are pressed by the members G and G without being heated, the inner flanges 11 and 11 can be formed but in contrast, the outer flanges I and I can not be formed. Namely, because the hardness of the rod B is high (in other words, the toughness thereof is low), parts of the rod, which respectively correspond to the outer flanges I and I, can not be deformed. Thus, in the case of the striker of the present invention, the outer flanges 5 and 5 are preliminarily formed on the rod 3. Then, only the inner flanges 11 and 11 are formed by caulking the rod by performing a cold-press-working.

Although the preferred embodiment of the present invention has been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A method of making a striker which has a non-hardened and non-tempered base for fixing to a vehicle body or a door of an automobile and further has a high-strength, hardened and tempered U-shaped member fixed to the base, comprising the steps of:

bending a high-strength steel rod to a "U" shape with leg portions and subsequently forming outer flanges on each of said leg portions of said high-strength steel rod;

hardening and then tempering the U-shaped rod provided with the outer flanges;

providing a non-hardened and non-tempered metal base having a pair of holes extending therethrough:

inserting the leg portions into said pair of holes in the base, respectively, until the outer flanges come into abutting engagement with an outer face of the base; and then cold forming inner flanges adjacent or at a tip of each of the leg portions without substantially heating the base or said tip of each of the leg portions, thereby firmly sandwiching the base between the inner flanges and the outer flanges.

2. A method according to claim 1 further comprising, prior to said inserting step, stamping a zinc-plated steel plate by press working to form said base.

3. A method according to claim 1 further comprising, prior to said inserting step, coating the base with resin.

4. A method according to claim 1, wherein the base has a strength of 30 to 40 kg/mm$^2$, and the U-shaped rod has a strength of at least 70 kg/mm$^2$.

5. A method according to claim 1, wherein the U-shaped rod is made of chrome molybdenum steel, chrome steel, nickel chromium steel, or nickel-chrome-molybdenum steel.

6. A method according to claim 1, wherein said cold forming step is carried out by caulking a tip of each of the leg portions by performing a cold-press-working to thereby form said inner flanges with the base being firmly sandwiched between the inner flanges and the outer flanges.

7. A method of making a striker which has a non-hardened and non-tempered metal base for fixing to a vehicle body or a door of an automobile and further has a high-strength, hardened and tempered U-shaped member fixed to the base, comprising the steps of:

forming outer flanges on both end parts of a high-strength steel rod, respectively, and subsequently bending the high-strength steel rod into a "U" shape thereby providing leg portions;

hardening and then tempering the U-shaped rod with said leg portions;

providing a non-hardened and non-tempered metal base having a pair of holes extending therethrough;

inserting the leg portions into said pair of holes in the base, respectively, until the outer flanges come into abutting engagement with an outer face of the base; without being significantly heated, and then cold caulking a tip of each of the leg portions by performing a cold-press-working, to thereby form inner flanges, whereby the base, without being significantly heated, is firmly sandwiched between the inner flanges and the outer flanges.

8. A method according to claim 7 further comprising, prior to said inserting step, stamping a zinc-plated steel plate by press working to form said base.

9. A method according to claim 7 further comprising, prior to said inserting step, coating the base with resin.

10. A method according to claim 7, wherein the base has a strength of 30 to 40 kg/mm$^2$, and the U-shaped rod has a strength of at least 70 kg/mm$^2$.

11. A method according to claim 7, wherein the U-shaped rod is made of chrome molybdenum steel, chrome steel, nickel chromium steel, or nickel-chrome-molybdenum steel.

12. A method of making a striker which has a non-hardened and non-tempered metal base for fixation to a vehicle body or a door of an automobile and further has a high-strength, hardened and tempered U-shaped member fixed to the base, comprising the steps of:

forming outer flanges on both end parts of a high-strength steel rod, respectively, and subsequently bending the high-strength steel rod into a "U"shape with leg portions;

hardening and then tempering the U-shaped rod;

providing a non-hardened and non-tempered metal base having a pair of holes extending therethrough;

inserting the leg portions into the pair of holes in the base, respectively, until the outer flanges come into abutting engagement with an outer face of the base; and then cold forming inner flanges adjacent or at a tip of each of the leg portions without substantially heating the base or said tip of each of the leg portions, thereby firmly sandwiching the base between the inner flanges and the outer flanges.

13. A method according to claim 12 further comprising, prior to said inserting step, stamping a zinc-plated steel plate by press working to form said base.

14. A method according to claim 12 further comprising, prior to said inserting step, coating the base with resin.

15. A method according to claim 12, wherein the base has a strength of 30 to 40 kg/mm$^2$, and the U-shaped rod has a strength of at least 70 kg/mm$^2$.

16. A method according to claim 12, wherein the U-shaped rod is made of chrome molybdenum steel, chrome steel, nickel chromium steel, or nickel-chrome-molybdenum steel.

* * * * *